United States Patent [19]

Lyle

[11] 4,293,231

[45] Oct. 6, 1981

[54] BEARINGLESS VIBRATOR

[76] Inventor: John S. Lyle, 671 Cody St., Lakewood, Colo. 80215

[21] Appl. No.: 109,782

[22] Filed: Jan. 7, 1980

[51] Int. Cl.[3] ..... B01F 11/00

[52] U.S. Cl. ..... 366/120; 366/124

[58] Field of Search ..... 366/120–126; 74/87

[56] References Cited

U.S. PATENT DOCUMENTS

| | | | |
|---|---|---|---|
| 2,187,088 | 1/1940 | Malan | 366/125 |
| 2,743,090 | 4/1956 | Malan | 366/125 |
| 3,260,509 | 7/1966 | Rudy et al. | 366/124 X |
| 3,376,021 | 4/1968 | Fontaine | 366/125 |
| 3,746,310 | 7/1973 | Fransson et al. | 366/124 X |
| 3,790,137 | 2/1974 | Wadensten | 366/125 |

*Primary Examiner*—Philip R. Coe

*Attorney, Agent, or Firm*—Sheridan, Ross, Fields & McIntosh

[57] ABSTRACT

A pneumatic vibrator is provided which operates without the use of bearings. The vibrator includes a generally cylindrically formed housing and a cylindrical shaped rotor contained within the housing. The housing includes an inlet for receiving pressurized fluid and an outlet for discharging the fluid. The rotor has a number of jets formed adjacent the periphery of the rotor and extending through the outer longitudinal surface thereof. The rotor also includes an axle member extending from the rotor and which engages a recess formed in an end of the housing. In operation, the inlet of the vibrator is connected to a source of pressurized air. At least a portion of one of the jets is aligned with the inlet to receive the pressurized air. The air discharged from the jet produces a thrust driving the rotor about the inner wall of the housing. As the rotor rolls in the housing, each jet in sequence is aligned with the inlet and receives pressurized air while the axle member moves adjacent the inner wall of the recess so that some portion of the outer longitudinal surface of the rotor remains in contact with a portion of the inner wall of the housing. The rotor thereby continues to roll against the inner wall of the housing and the impacting therebetween causes vibrations.

21 Claims, 9 Drawing Figures

16
18
14
12
14

20
18
4
24
10
22
26

4
18
28
24
30
32

20
80
78
48
44
46
38
34
36
42
42
36
40
68
68
66
74
74
70
70
72
72
76
54
26
64
56
62
50
52

BEARINGLESS VIBRATOR

DESCRIPTION

1. Technical Field

This invention relates to a pressurized fluid driven vibrator and, in particular, to a bearingless pneumatic vibrator wherein a rotor is rotated eccentrically within a housing thereby inducing vibrations.

2. Background Art

Pneumatic vibrators which function without the use of bearings are known. Such vibrators are used in settling or compacting fresh concrete. In U.S. Pat. No. 2,187,088 to Malan a vibrator is described having a casing which houses a rotor. The rotor includes slots containing vanes which move outwardly of the rotor, upon application of air pressure thereto, to contact the inner surface of the casing. Air is supplied successively to chambers through passages formed in the rotor. The passages cross each other in the rotor and the air is delivered to both of the opposing surfaces of the rotor. The pressurized chambers act to force the rotor about the casing while the extending/retracting vanes movably seal the chambers. In U.S. Pat. No. 2,743,090 also to Malan, a vibrator is described including a casing and a rotor. The rotor has separate ports for delivery of pressurized air to vanes and then to chambers to aid in the starting motion of the rotor. In U.S. Pat. No. 3,790,137 to Wadensten a pneumatic vibrator is disclosed including a housing within which a rotor rolls eccentrically about a shaft. The shaft has a radial slot for receiving a vane. Pressurized fluid moves the vane within the slot while bores formed in the shaft provide passage ways for the fluid to rotate the rotor. In U.S. Pat. No. 3,376,021 to Fontaine a vibrator is described including a stationary inner cylinder about which an outer cylinder rotates. A duct is formed in the stationary cylinder and receives pressurized fluid for delivery to a groove housing a paddle. The paddle has recesses so that the fluid moves therethrough to chambers formed on opposite sides of the paddle. The rotatable outer cylinder has an eccentric weight for altering the vibration pattern of the device. In U.S. Pat. No. 3,746,310 to Fransson et al. a fluid driven vibrator is shown which does not use a movable vane. The vibrator includes a housing on which a rotor is fitted. Bushings having threads are fitted within the housing while threads are also formed on the rotor. A different number of starts of the threads are provided in the bushings and rotor so that the pressurized air passes along the spiral loop formed by the threads to move the rotor. In U.S. Pat. No. 3,260,509 to Rudy et al. a vibrator is disclosed which uses the jet reaction principle in operation. A plurality of jet orifices simultaneously receive pressurized air and discharge the air against a casing adjacent a lower end of a rotor to cause the rotor to rotate within the casing. The rotor is supported on a shaft having sleeve bearings.

The foregoing patent references disclose a variety of vibrators. However, none describes a bearingless vibrator including a cylindrical rotor having a number of jets which successively communicate with pressurized fluid so that the direct force of the pressurized fluid exiting each of the jets drives the rotor, as discussed hereinbelow. The vibrator of the present invention has a rotor which acts as a turbine in using the velocity of the pressurized fluid exiting the jets and does not use vanes or other chamber forming means to provide a positive displacement motor wherein the pressure in a chamber causes a rotor to rotate eccentrically.

DISCLOSURE OF THE INVENTION

In accordance with the present invention, a pneumatic vibrator is provided comprising a housing having a chamber for containing a rotor. The rotor has a number of jets formed therein which are symmetrically spaced about the periphery of the rotor. The rotor also includes an axle member which is insertable into a recess formed adjacent a nose end of the housing. The housing has an inlet for receiving a pressurized fluid which is directed to at least one of the jets. The reactive force of the pressurized fluid sequentially exiting each of the jets results in a rolling motion of the rotor within the chamber. As the rotor rolls along adjacent the inner wall or race of the housing, each of the jets sequentially aligns with the inlet to receive the pressurized fluid while the axle member moves in the recess to assure rotor contact with the housing. The rotor continues to move by means of the resulting thrust produced by the exiting fluid of each of the jets.

More particularly, a completely bearingless vibrator is provided comprising a generally cylindrical housing and a generally cylindrical rotor having a diameter less than the inside diameter of the housing. The housing includes a first casing and a second casing removably connected to the first casing. The second casing includes a nose end and a chamber formed in the second casing for containing the rotor. A port member is attached to the first casing and includes an inlet for connection to a tube or hose which carries pressurized fluid. The port member also includes a number of outlets or spaces separated from the inlet through which the pressurized fluid escapes after passing through jets formed in the rotor. Each of the jets is symmetrically positioned about the periphery of the rotor with the radial distance from the center axis of the rotor to each of the jets being substantially the same. An axle member or shaft is integrally joined to an end of the rotor. The axle member is inserted in a recess formed in the second casing adjacent its nose end to assure that the rotor rolls eccentrically adjacent the inner surface of the second casing. In operation of the vibrator, pressurized fluid enters the inlet and passes through at least a portion of one of the jets. The pressurized fluid exits a jet portion aligned with the inlet resulting in a thrust reaction whereby the rotor is driven about the inner wall of the second casing. As the rotor moves therein, all portions of each jet are successively aligned with the inlet carrying the pressurized fluid so that continuous thrusts are produced to drive the rotor. Accordingly, impact results between the rotating rotor and the second casing thereby producing vibrations.

In view of the foregoing description a number of worthwhile advantages of the present invention are readily apparent. A pneumatic vibrator is provided which operates efficiently without the use of any bearings. Jets positioned at the periphery of the rotor receive pressurized fluid in sequence as the rotor rolls to continually drive the rotor by means of the reactive forces produced by the exiting of the pressurized fluid. The axle member inserted in the recess centrally formed in the housing assures continuing contact between the rotor and the race of the housing and substantially prevents rotation of the rotor about its own axis. Strong vibrations result from the driven rotor against the housing so the present invention has desirable utility in settling recently poured concrete. Furthermore, the vibrator is easily and economically constructed of a minimum of structural elements. Additional advantages will become apparent from the following description taken in conjunction with the accompanying drawings.

DESCRIPTION OF THE PREFERRED EMBODIMENT

Figures 1, 2, 3:
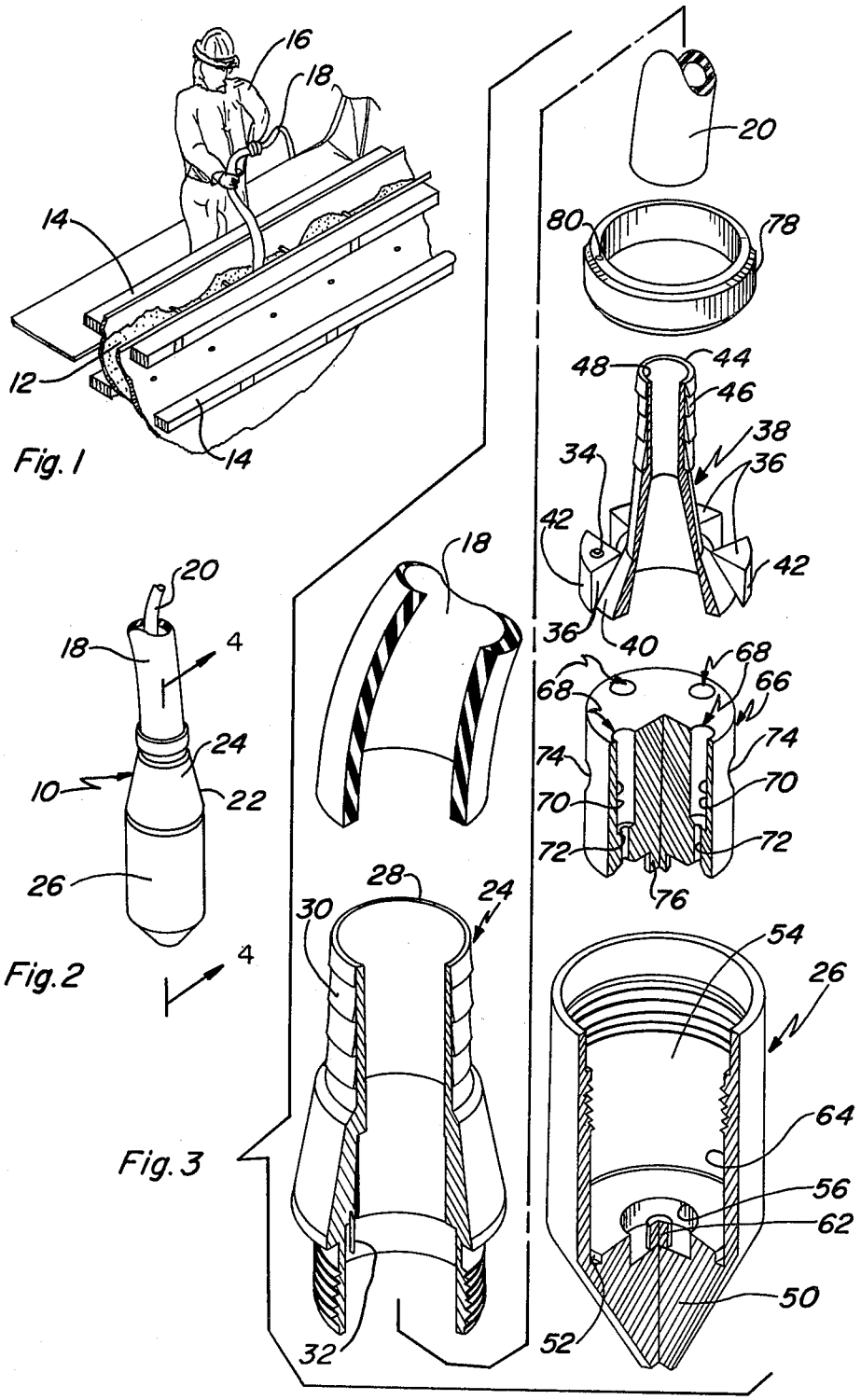
FIG. 1 is a perspective view of the vibrator of this invention being used in settling concrete.
FIG. 2 is a perspective view of the vibrator together with inlet and outlet hoses for carrying air to and from the vibrator, respectively.
FIG. 3 is an exploded view showing separately the parts of the vibrator together with the inlet and outlet hoses.

In accordance with the present invention, a vibrator 10, depicted in FIG. 2, is provided for use in settling freshly poured concrete 12, as illustrated in FIG. 1. The vibrator 10 is immersed in the concrete 12 which is surrounded by forms 14 for retaining the concrete 12 therein until it solidifies. The worker 16 holds outer or exhaust hose 18, which is connected to vibrator 10, to position the vibrator 10 within the concrete 12. A source of pressurized air (not shown) supplies the pressurized air to the vibrator 10 through inner or inlet hose 20, which is shown in FIG. 2 surrounded by exhaust hose 18. The pressurized air enables the vibrator 10 to produce vibratory forces or vibrations. These vibrations are transmitted to the concrete 12. The concrete 12 is thereby settled or compacted into a desired state. After compacting, the vibrator 10 is removed before the concrete 12 has set.

The elements comprising vibrator 10 are best seen in FIG. 3, together with the exhaust hose 18 and inlet hose 20. The vibrator 10 includes a generally cylindrical housing 22 having a first casing 24 and a second casing 26. The first casing includes a first end or outlet member 28 having ridges 30 for conveniently engaging exhaust hose 18. The second or opposite end of the first casing 24 is exteriorly threaded. A locking pin 32 is located within the first casing at the second end thereof. Locking pin 32 is insertable into a hole 34 formed in one of the ribs 36 of the port member 38. Port member 38 also includes a body portion 40 to which ribs 36 are integrally joined and extend therefrom. Ribs 36 are symmetrically positioned about body portion 40 and have generally rectangular sides 42 so that when locking pin 32 is inserted into hole 34 each side 42 contiguously contacts the inner surface of the second end of first casing 24. Body portion 40 has a flat, generally circular outer face. Body portion 40 tapers from its outer face to a smaller diameter than that of the outer face where it is integrally joined with inlet member 44. Inlet member 44 is generally cylindrical in shape and extends from body portion 40. The inlet member 44 includes webs 46 for engaging inlet hose 20. The inlet member 44 also has an opening 48. The opening 48 extends through the center of the outer face of body portion 40.

The second casing 26 has a first end which is threaded interiorly to engage the exterior threads of first casing 24 to complete the housing 22 and also provide an air tight seal. The second casing 26 is generally cylindrical but includes a nose or second end 50 which tapers to a flat point of substantially smaller diameter than that of the cylindrical portion of the second casing 26.

A groove 52 is formed adjacent the inner wall or race 54 of the second casing 26 near the portion of second casing 26 where nose end 50 joins with the cylindrical portion of second casing 26. Formed inwardly of the groove 52 is a generally cylindrical recess 56 which extends through a portion of nose end 50. The recess 56 has a diameter substantially equal to the diameter of opening 48 at the outer face of body portion 40. Recess 56 is formed generally in the center of second casing 26 so that the longitudinal center axis of second casing 26 is coaxial with the center axis of recess 56. Similarly, opening 48 of port member 38 is coaxial with recess 56.

A bar or post 62 generally cylindrical in shape but of a smaller diameter than recess 56 is located in the center of recess 56 and is, therefore, coaxial therewith. Bar 62 is integrally joined to the nose end 50 where the recess 56 terminates in nose end 50. The length of bar 62 is less than the depth of recess 56.

For positioning within the housing 22 and, specifically, to be located in chamber 64 of second casing 26 is rotor 66. Rotor 66 is generally cylindrical in shape and symmetrically balanced in weight. Rotor 66 has a pair of opposing flat surfaces. Symmetrically formed adjacent the periphery of the rotor 66 are a plurality of jets 68. Although the rotor 66 is depicted herein as having four jets, it is readily appreciated that a greater or lesser number of jets 68 can be used. It is necessary that the size and number of jets be sufficient so that rotor 66 is satisfactorily driven by the pressurized air, as will be subsequently explained, without unduly multiplying the number of jets 68. In addition, although jets 68, as depicted in the drawings, are symmetrically formed in the rotor 66, this symmetry is not critical for proper operation of the vibrator. The jets 68 can also be formed asymmetrically in the rotor 66.

Figure 4:
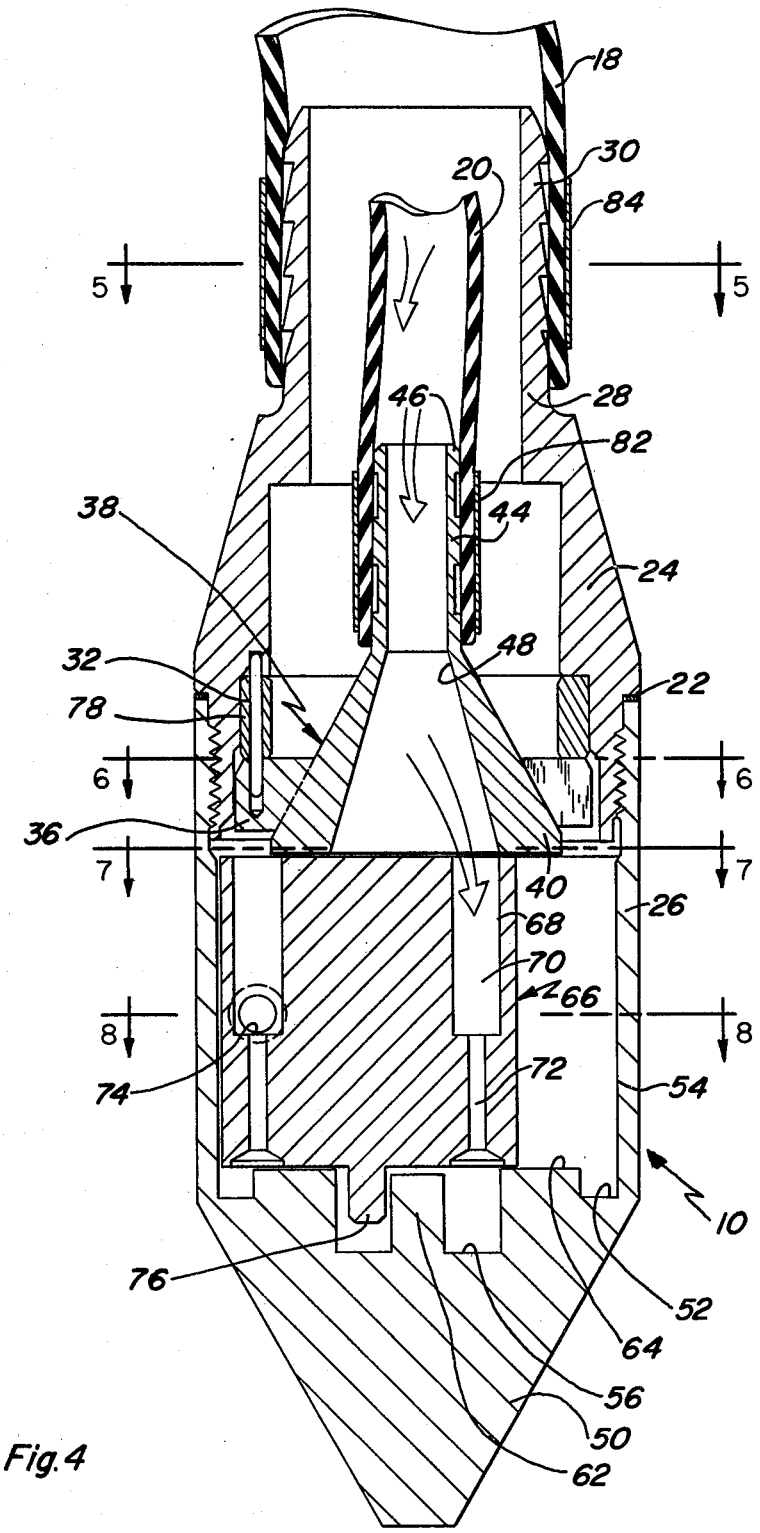
FIG. 4 is a longitudinal section, taken along line 4—4 of FIG. 2, showing the interconnected parts of the vibrator.
Figure 8:
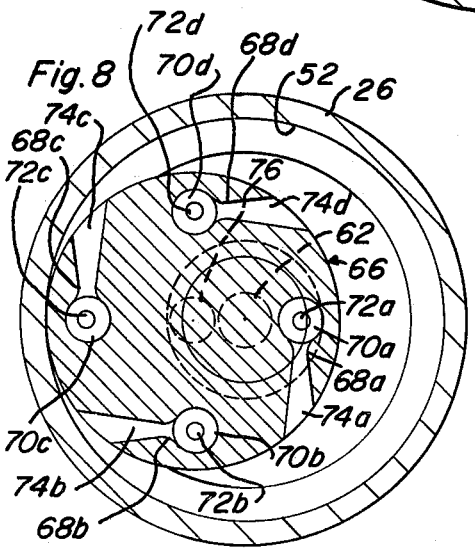
FIG. 8 is a lateral section, taken along line 8—8 of FIG. 4, showing air exiting the jet aligned with the opening in the port member.
Figure 9:
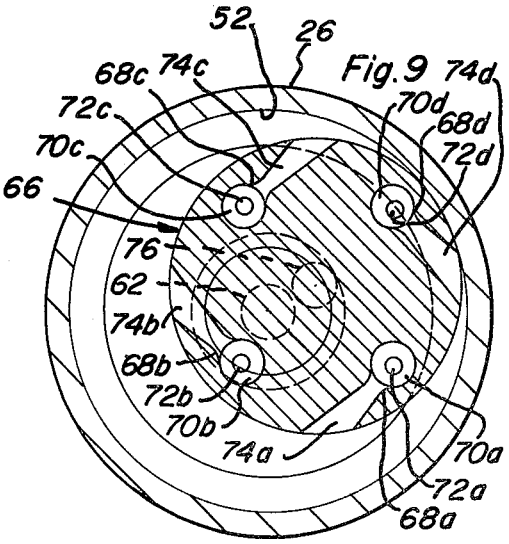
FIG. 9 is a lateral section, similar to FIG. 8, but illustrating the movement of the rotor whereby another jet is aligned with the opening in the port member to receive the pressurized air.

Each jet includes a cylindrically formed first passage 70 which extends longitudinally from a first surface of rotor 66 to approximately the midportion of rotor 66. When rotor 66 is placed in chamber 64, first surface of rotor 66 is located adjacent the junction of first casing 24 and second casing 26. A cylindrical second passage 72, coaxial with the first passage 70, extends longitudinally from the midportion of rotor 66 through the second or opposing surface thereof, which is positioned adjacent the nose end 50. Second passage 72 increases in size near this second rotary surface providing an opening substantially corresponding in size to the first passage 70, as shown in FIG. 4. First passage 70 and second passage 72 together form an opening through rotor 66, which is parallel to the longitudinal center axis of rotor 66. Each jet 68 also includes a channel or nozzle 74. Channel 74 is formed through the outer, cylindrical, elongated wall of the rotor 66. Channel 74 extends generally tangentially or at a right angle with respect to first and second passages 70, 72. As best illustrated in FIGS. 8 and 9, each of the channels 74 enlarges in size adjacent the outer cylindrical wall of rotor 66 to further enhance the reaction force produced by the pressurized fluid exiting therefrom, as will be discussed later. Channel 74 is formed, preferably, near the midportion of rotor 66 adjacent the junction of first passage 70 and second passage 72. However, it is readily appreciated that jets 68 can be formed in rotor 66 such that channels 74 are relatively more adjacent one of the flat surfaces of rotor 66 rather than the midportion of rotor 66. The passages 70, 72 and channels 74 are formed in the rotor 66 such that no passage 70, 72 or channel 74 crosses either another passage 70, 72 or another channel 74. Consequently, there are no intricate or complicated air passage arrangements. Additionally, no passage 70, 72 need be blocked at its end to prevent the unwanted discharge of pressurized air.

Integrally connected to the second surface of rotor 66 is axle member or shaft 76. Axle member 76 extends from the center axis of rotor 66 and has a length less than the depth of first recess 56. Axle member 76 is generally cylindrical in shape but includes a chamfered end.

A spacer element 78 is also shown in FIG. 3. Spacer element 78 is generally ring-shaped and acts as a shim in bearing against body portion 40 to position body portion more adjacent rotor 66 when vibrator 10 is assembled. The spacer element 78 has an aperture 80 so that locking pin 32 can be inserted therethrough. It is easily understood that spacer element 78 can have a variety of thicknesses to substantially minimize the need for extremely close tolerances for rotor 66 and port member 38. As a consequence, unwanted leakage of air between the flat outer face of body portion 40 and the rotor surface during operation of the vibrator is minimized without unduly restricting the tolerances of rotor 66 and port member 38.

Figure 5:
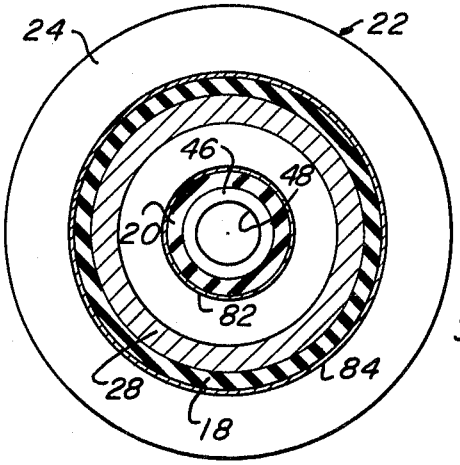
FIG. 5 is a lateral section, taken along line 5—5 of FIG. 4, showing the connection of the air inlet and outlet members of the vibrator to the inlet and outlet hoses, respectively.
Figure 6:
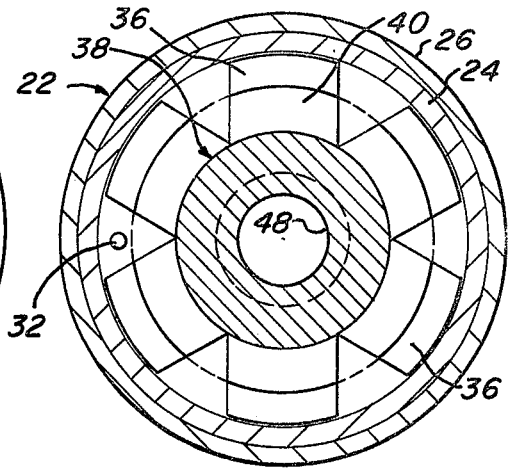
FIG. 6 is a lateral section, taken along line 6—6 of FIG. 4, showing the port member for carrying air to the rotor and for separately receiving air exhausted by the rotor.

When the elements of vibrator 10 are assembled, the interconnection of the elements is best illustrated in FIGS. 4-7. Initially, a spacer element 78 of the necessary thickness is connected to first casing 24 by inserting locking pin 32 through aperture 80. Port member 38 is then positioned to engage first casing 24 and overlie spacer element 78 by means of the interconnection of locking pin 32 and hole 34 so that inlet member 44 extends into first casing 24. The sides 42 of ribs 36 of port member 38 contact the inner surface of first casing 24, as seen in FIG. 6. The inlet hose 20 is mounted around the inlet member 44 by means of a convenient clamping member 82 so that a seal is provided to prevent the leakage of air from inlet hose 20 where it is joined to inlet member 44, as illustrated in FIGS. 4 and 5. Rotor 66, which has a smaller diameter than the inside diameter of the second casing 26, is placed into chamber 64 of second casing 26 such that axle member 76 is inserted into first recess 56. First casing 24 and second casing 26 are connected together by means of the threaded arrangement at their joined ends so that the flat outer face of body portion 40 is adjacent the flat first surface of rotor 66. The exhaust hose 18 surrounds the outlet member 28 of first casing 24. A conventional fastening member 84 is mounted around the exhaust hose 18, as depicted in FIGS. 4 and 5, so that a seal is provided to prevent the leakage of air from exhaust hose 18 where it is joined to outlet member 28.

Figure 7:
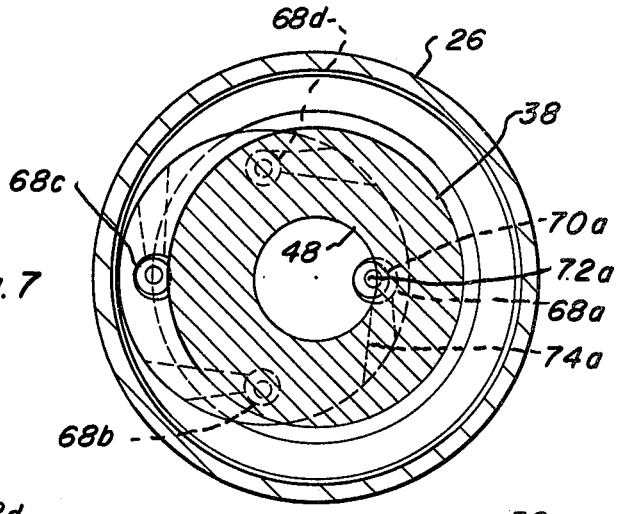
FIG. 7 is a lateral section, taken along line 7—7 of FIG. 4, showing details of the rotor jets.

As illustrated by the arrows shown in FIG. 4, fluid, including air, under pressure is applied through inlet hose 20. The pressurized air passes through common opening 48 of inlet member 44 and body portion 40. The air then flows into one of the jets 68 formed in rotor 66. As illustrated in FIG. 7, the air moves into jet **68*a* since it is aligned with opening 48. Each of the first passages 70 of jets 68 has a diameter such that opening 48 always communicates with at least a longitudinally extending portion of one of the first passages 70. Hence, rotor 66 is immediately driven upon delivery of pressurized air thereto so that altering the position of rotor 66 in the vibrator 10 in order to align opening 48 with at least one of the jets 68 is not required. Thus, rotor 66 has no stall position. Air moves into a first passage 70*a* of jet 68*a* which is aligned with opening 48, as illustrated in FIGS. 7 and 8. A substantial portion of the pressurized air escapes through channel 74*a*. This discharging of air results in the movement of the rotor 66 along the smooth inner wall or race 54 in a clockwise direction, when viewed in the direction of the nose end 50 from first casing 24, due to the positioning of the channels 74. The discharging of air from the channels 74 in a tangential path relative to the rotor 66 provides thrust or reaction forces which drive the rotor 66 eccentrically about the center longitudinal axis of second casing 26. As illustrated in FIGS. 8 and 9, the thrust produced by the discharged air moves rotor 66 so that first passage 70*b* of jet 68*b* is now aligned with opening 48 to receive the pressurized air. Similarly, jets 68*c* and 68*d* are successively brought into registration with opening 48 to receive the pressurized air. The pressurized air driven rotor 66 impacts against the race 54 as it rolls producing vibratory forces with the second casing 26. These vibratory forces are of a sufficient amplitude and frequency to satisfactorily settle the concrete 12**.

After exiting the channels 74 of jets 68, the air passes through the spaces between the ribs 36 of port member 38. This exhaust air is received by the outer hose 18 and is carried from the vibrator 10.

The eccentric path of rotor 66 along the race 54 is maintained since the axle member 76 inserted into recess 56 eccentrically guides the rotor while centrifugal forces keep the axle member 76 in contiguous contact with the inner surface of first recess 56. The centrifugal forces also act to maintain a portion of rotor 66 against race 54. Additionally, the bar 62 prevents the axle member 76 from becoming coaxial with the longitudinal center axis of second casing 26. As a result, rotor 66 cannot become coaxial with respect to the center longitudinal axis of second casing 26 and eccentricity is thereby maintained.

In addition to exhausting air through channels 74 of jets 68, some pressurized air also flows from rotor 66 through second passages 72 into recess 56. The purpose of second passages 72 is to prevent pressurized air directed into the rotor 66 from forcing rotor 66 towards and against the nose end 50 of second casing 26. If this occurred, the friction forces resulting from the rotor 66 against the nose end 50 could not be overcome and the rotor 66 would stall or not move in second casing 26. Each of the second passages 72 delivers air to recess 56 thereby providing a pocket of air therein which balances forces tending to drive the rotor 66 against nose end 50. The rotor 66 then rides on or is supported at its second surface by this film of air. Consequently, the rolling motion of rotor 66 about race 54 is not impeded by forces acting in the direction of the longitudinal axis of the rotor 66.

In the embodiment depicted in FIGS. 3 and 4, each of the second passages 72 is less in diameter than each of the first passages 68. However, this configuration need not be utilized. For example, a rotor 66 of a relatively smaller diameter does not require that second passages 72 be less in diameter than first passages 70. In fact, passages 70, 72 can be of the same diameter. It is necessary that sufficient air be carried through second passages 72 to supply air to recess 56, to compensate for the loss of air therefrom as the rotor 66 moves in the housing 22. Hence, adequate forces are continually present due to the air in recess 56 to balance axial forces tending to drive the rotor against the nose end 50. In addition, as previously noted, second passages 72 have a greater diameter or size adjacent the second surface of rotor 66 or where pressurized air exits the rotor 66 at nose end 50. This structural feature, in the embodiment seen in FIGS. 3 and 4, also assures a balancing of forces by providing additional area for the housing of air adjacent the nose end 50 to counteract axial forces acting in the direction of the nose end 50. Further balancing forces are provided by the air present in groove 52 adjacent race 54.

In operation, whenever opening 48 communicates with first passage 70*a*, second passage 72*a* is in registration with recess 56. Thus, air exiting second passage 72*a* supplies air to recess 56. This contained air, together with the enlarged size of second passage 72*a* adjacent nose end 50, provide a force in an opposing direction to prevent rotor 66 from being held against the nose end 50 of second casing 26. As the rotor 66 moves within the housing, the air trapped in second passage 72*a* is released since passage 72*a* moves out of alignment with recess 56 and opening 48. Similarly, whenever opening 48 communicates with first passages 70*b*, 70*c*, or 70*d*, second passages 72*b*, 72*c*, and 70*d*, respectively, are aligned in registration with recess 56 so that the axial forces are constantly balanced and the rotor 66 continues along its eccentric path in chamber 64.

From the foregoing description, a number of readily discernible advantages of the present invention are set forth. A bearingless vibrator of relatively few parts for use in settling fresh concrete is provided. The vibrator parts are constructed of a strong and durable metal to minimize wear and generate strong vibratory forces. The vibrator includes a rotor which acts as a turbine wherein the velocity of a pressurized fluid discharged therefrom directly moves the rotor. The rotor itself is formed with guide means to assure an eccentric path in the vibrator housing when driven by pressurized air. Further, the rotor is formed without complicated and intricate ports, valves and chamber forming means. The reaction forces generated by the discharging of pressurized air from the jets in a tangential direction readily drive the rotor. Also, pressurized air needed to drive the rotor is minimized while air exiting the rotor through passages into a recess formed in the nose end of the housing counteracts forces tending to drive the rotor against the nose end and thereby impede its rolling motion. In addition, the rotor is self-starting and does not include a stall position so that the rotor need not be moved in order that the pressurized air communicate with a jet in the rotor.

Althrough the present invention has been described in detail with reference to a particular embodiment thereof, it is readily understood that various modifications can be effected within the spirit and scope of this invention.

I claim:

1. A bearingless vibrator devoid of chamber forming means and having a rotor acting as a turbine upon communication with a pressurized fluid, said vibrator comprising:

a housing having a center axis and an inner wall, said housing including inlet means for receiving the pressurized fluid and outlet means for discharging the fluid;

a rotor having a center axis and contained for rolling movement within said housing, said rotor including a plurality of jets formed adjacent the periphery of said rotor, each jet having an inlet end and an outlet end at the periphery of said rotor, an inlet end of each jet communicating in sequence with said inlet means as said rotor rolls in said housing to receive the pressurized fluid so that thrust produced by the velocity of the pressurized fluid sequentially exiting each of said outlet ends of said jets drives said rotor eccentrically relative to said center axis of said housing, said rotor impacting against said housing to produce vibrations; and guide means contained within said housing for maintaining a portion of said rotor in contact with said inner wall of said housing as said rotor eccentrically moves therewithin.

2. The vibrator, as claimed in claim 1, wherein:

said guide means includes shaft means connected to said rotor and immovable relative to said rotor.

3. The vibrator, as claimed in claim 2, wherein:

said guide means includes receiving means formed in an end of said housing for receiving said shaft means as said rotor eccentrically moves so that said rotor remains adjacent said inner wall of said housing.

4. The vibrator, as claimed in claim 3, wherein:

said receiving means includes a recess formed in an end of said housing, said recess having an inner surface along which said shaft means moves as said rotor rotates eccentrically about said center axis of said housing.

5. The vibrator, as claimed in claim 4, wherein:

said rotor includes a first passage communicating with said inlet means and extending for a portion of the distance through said rotor and a second passage in communication with said first passage and extending through the remaining distance of said rotor so that pressurized fluid is supplied to said recess and an imbalance of pressurized fluid tending to drive said rotor towards said recess and away from said inlet means is minimized.

6. The vibrator, as claimed in claim 5, wherein:

said second passage has a width less than the width of said first passage throughout a substantial portion of its length.

7. The vibrator, as claimed in claim 6, wherein:

the width of said second passage increases adjacent an end of said rotor positioned near said recess.

8. The vibrator, as claimed in claim 2, wherein:

said shaft means includes a generally cylindrical shaped axle member fixed to an end of said rotor.

9. The vibrator, as claimed in claim 1, wherein:
said guide means includes post means coaxial with said center axis of said housing so that said rotor is prevented from rotating about its own center axis.

10. The vibrator, as claimed in claim 1, wherein:
the pressurized air from said inlet means is directed into said rotor in a single direction.

11. The vibrator, as claimed in claim 1, wherein:
said rotor is generally cylindrical in shape and the radial distance from said center axis thereof to each of said jets is substantially the same.

12. The vibrator, as claimed in claim 11, wherein:
said jets are symmetrically spaced about the periphery of said rotor.

13. The vibrator, as claimed in claim 1, wherein:
the number of jets communicating with said inlet and receiving the pressurized fluid as said rotor rotates in said housing at any one time is no greater than two.

14. The vibrator, as claimed in claim 1, wherein each of said jets includes:
a first passage parallel to said center axis of said housing for communicating with said inlet means as said rotor rotates and extending for a portion of the distance through said rotor; and
a channel communicating with said first passage and extending through the periphery of said rotor while forming an angle with respect to said first passage.

15. The vibrator, as claimed in claim 14, wherein:
the angle formed by the communication of said first passage and said channel is substantially 90° so that, when each of said jets communicates with said inlet means, the pressurized fluid escapes each of said jets in a tangential path relative to said rotor.

16. The vibrator, as claimed in claim 1, wherein:
said housing includes a first casing and second casing removably joined to said first casing; and
said inlet means includes a port member having ribs spatially disposed about the periphery thereof and extending outwardly therefrom.

17. A vibrator, as claimed in claim 16, wherein:
said port member includes locking means for connecting said port member to said first casing so that said port member is stationary during the rotation of said rotor within said housing.

18. The vibrator, as claimed in claim 16, wherein:
said port member has an opening through which the pressurized fluid passes into each of said jets.

19. The vibrator, as claimed in claim 16, wherein:
said outlet means includes the spaces between said ribs.

20. A vibrator driven by pressurized fluid, comprising:
a first casing having a center axis and including a first end attachable to an outlet hose for carrying the fluid exhausted by the vibrator and a second end opposite said first end;
a port member including a tapering body portion having a flat outer face and an inlet member integrally joined to said body portion for connection to an inlet hose for carrying the pressurized fluid, said body portion and said inlet member having a common opening through which the pressurized fluid passes, said common opening concentric with said center axis of said first casing;
a plurality of ribs having sides, each of said ribs integrally joined to the periphery of said body portion and symmetrically, spatially disposed thereabout, each of said rib sides contacting the inner surface of said first casing;
locking means on said first casing and said port member to removably connect said first casing and said port member together;
a second casing having a longitudinal center axis and an inner wall and including:
a first end removably connected to said second end of said first casing,
a second end,
a cylindrical portion having a chamber, between said first and second ends, and
a recess concentrically formed relative to said longitudinal center axis of said second casing where said cylindrical portion joins with said second end of said second casing;
a bar connected to said second end of said second casing and concentric with said recess, said bar having a length substantially equal to the depth of said recess;
a cylindrical rotor having a center axis and a diameter less than the inside diameter of said cylindrical portion of said second casing so that said rotor is adaptable to be placed into said chamber and roll eccentrically along said inner wall of said second casing, said rotor including:
a flat first end positioned adjacent said first end of said second casing,
a flat second end positioned adjacent said second end of said second casing,
a plurality of first passages, each of said first passages extending longitudinally through said rotor from said first end of said rotor to substantially the midportion thereof,
a plurality of second passages, each of said second passages concentric with one of said first passages and extending from where said first passage ends through said second end of said rotor so that an opening is formed through the entire longitudinal extent of said rotor, and
a plurality of channels, each of said channels communicating with one of said first passages and extending through said rotor substantially adjacent the longitudinal midportion thereof, each of said channels at a right angle relative to said corresponding first passage so that, when said common opening of said port member successively registers with each of said first passages, a substantial portion of the pressurized fluid enters said first passage and is discharged through said channel in a tangential path relative to said rotor to drive said rotor eccentrically along said inner wall of said rotor; and
a cylindrical shaft integrally joined to said rotor and extending coaxial with said center axis thereof, said shaft positioned in said recess of said second casing so that at least a portion of one of said first passages communicates with said port member common opening, said shaft acting to maintain said rotor adjacent said inner wall of said second casing to produce vibrations as said rotor rolls therealong while said bar prevents said shaft from being positioned coaxial with said longitudinal center axis of said second casing so that said rotor rotates eccentrically relative thereto.

21. A bearingless vibrator devoid of chamber forming means and having a rotor acting as a turbine upon communication with a pressurized fluid, said vibrator comprising:

a housing having a center axis and an inner wall, said housing including inlet means for receiving the pressurized fluid and outlet means for discharging the fluid; and a rotor having a center axis and contained for rolling movement within said housing, said rotor including a plurality of jets formed adjacent the periphery of said rotor, each jet having an inlet end and an an outlet end at the periphery of said rotor, an inlet end of each jet communicating in sequence with said inlet means as said rotor rolls in said housing to receive the pressurized fluid so that thrust produced by the velocity of the pressurized fluid sequentially exiting each of said outlet means of said jets drives said rotor eccentrically relative to said center axis of said housing, said rotor impacting against said housing to produce vibrations.

* * * * *